US009784002B2

(12) United States Patent
Cymbala

(10) Patent No.: US 9,784,002 B2
(45) Date of Patent: Oct. 10, 2017

(54) STRONGBACK WALER BRACKET AND METHODS OF USING THE SAME

(71) Applicant: P & W Construction Materials and Consulting Ltd., Calgary (CA)

(72) Inventor: Patrick Cymbala, Calgary (CA)

( * ) Notice: Subject to any disclaimer, the term of this patent is extended or adjusted under 35 U.S.C. 154(b) by 41 days.

(21) Appl. No.: 14/932,772

(22) Filed: Nov. 4, 2015

(65) Prior Publication Data

US 2016/0258170 A1 Sep. 8, 2016

Related U.S. Application Data

(60) Provisional application No. 62/127,872, filed on Mar. 4, 2015.

(51) Int. Cl.

| | |
|---|---|
| ***E04G 17/14*** | (2006.01) |
| ***E04G 17/02*** | (2006.01) |
| ***E04G 5/06*** | (2006.01) |
| ***E04G 11/12*** | (2006.01) |
| ***E04G 17/00*** | (2006.01) |

(52) U.S. Cl.

CPC ..... *E04G 17/14* (2013.01); *E04G 5/067* (2013.01); *E04G 11/12* (2013.01); *E04G 17/002* (2013.01); *E04G 17/02* (2013.01)

(58) Field of Classification Search

CPC ..... E04G 17/02; E04G 17/002; E04G 17/12; E04G 17/14; E04G 5/04; E04G 5/06; E04G 5/061; E04G 5/067

USPC ..... 248/235; 249/219.1, 219.2

See application file for complete search history.

(56) References Cited

U.S. PATENT DOCUMENTS 1,300,436 A * 4/1919 McKay ..... E04G 17/04 249/192
1,413,693 A * 4/1922 Venable ..... E04G 11/22 249/20
1,509,835 A * 9/1924 Grossenbach ..... E04G 17/04 249/219.2
1,520,965 A * 12/1924 Pulis ..... E04G 17/14 249/192
1,629,899 A * 5/1927 Wustholz ..... E04G 17/0658 249/191
1,911,701 A * 5/1933 Lynch et al. ..... E04G 17/0721 249/219.1
1,919,751 A * 7/1933 Schenk ..... E04G 17/0721 249/212
2,188,400 A * 1/1940 Bosco ..... E04G 17/045 24/68 FP
RE22,644 E * 5/1945 Stroben ..... E04G 11/12 248/224.7
2,680,459 A * 6/1954 Dodson ..... E04G 17/02 24/524

(Continued)

*Primary Examiner* — Michael Safavi
(74) *Attorney, Agent, or Firm* — Parlee McLaws LLP (CGY); Sean Goodwin

(57) ABSTRACT

Brackets for securing vertical strongbacks to horizontal walers secured to a face of a concrete wall form. Each bracket has a flange adapted to be mounted to an upper surface of the waler, a standoff connected to the flange and extending perpendicular to and beyond the waler to a distal end for defining a strongback-receiving pocket between the waler and the distal end for receiving the strongback. A wedge is operatively coupled to the distal end for pinching the strongback between the wedge and the waler for securing the strongback to the waler.

18 Claims, 15 Drawing Sheets

(56) References Cited

U.S. PATENT DOCUMENTS 3,007,221 A * 11/1961 Kenney ..... E04G 17/02 248/228.2
3,011,242 A * 12/1961 Matheson ..... E04G 17/0721 249/190
3,018,538 A * 1/1962 Gates ..... E04G 17/0754 249/219.2
3,030,061 A * 4/1962 Jennings ..... E04G 17/14 248/228.2
3,190,601 A * 6/1965 Williams ..... E04G 17/02 248/231.31
3,273,848 A * 9/1966 Allen ..... E04G 17/0721 248/250
3,547,398 A * 12/1970 Furr ..... E04G 17/0721 249/219.2
3,589,666 A * 6/1971 Kirby ..... E04G 17/0721 249/213
3,674,234 A * 7/1972 Davin ..... E04G 17/002 182/87
3,698,680 A * 10/1972 Shoemaker ..... E04G 17/002 182/82
3,712,576 A * 1/1973 Dagiel ..... E04G 17/045 249/192
3,724,806 A * 4/1973 Shoemaker ..... E04G 17/07 249/219.2
3,815,862 A * 6/1974 Williams ..... E04G 17/0742 249/219.2
3,888,456 A * 6/1975 Umstead ..... E04G 17/02 249/216
4,054,259 A * 10/1977 Johnson ..... E04G 17/02 249/219.2
4,058,285 A * 11/1977 Walski ..... E04G 17/0651 249/216
4,304,388 A * 12/1981 Gates ..... E04G 17/02 249/219.2
4,508,310 A * 4/1985 Schultz ..... E04G 17/02 249/189
4,643,388 A * 2/1987 Tazawa ..... E04G 17/04 248/205.1
4,791,767 A * 12/1988 Boeshart ..... E04B 2/8641 24/498
5,562,845 A * 10/1996 Miller ..... E04G 17/042 249/192
5,956,922 A * 9/1999 Liuska ..... E04G 11/065 249/216
5,968,403 A * 10/1999 Myers ..... E04G 17/045 249/219.2
2002/0020799 A1* 2/2002 McSwain ..... E04G 11/062 249/219.2
2006/0255236 A1* 11/2006 Shidler ..... E04G 11/12 249/219.2
2008/0173788 A1* 7/2008 Brewka ..... E04G 11/10 249/189

* cited by examiner

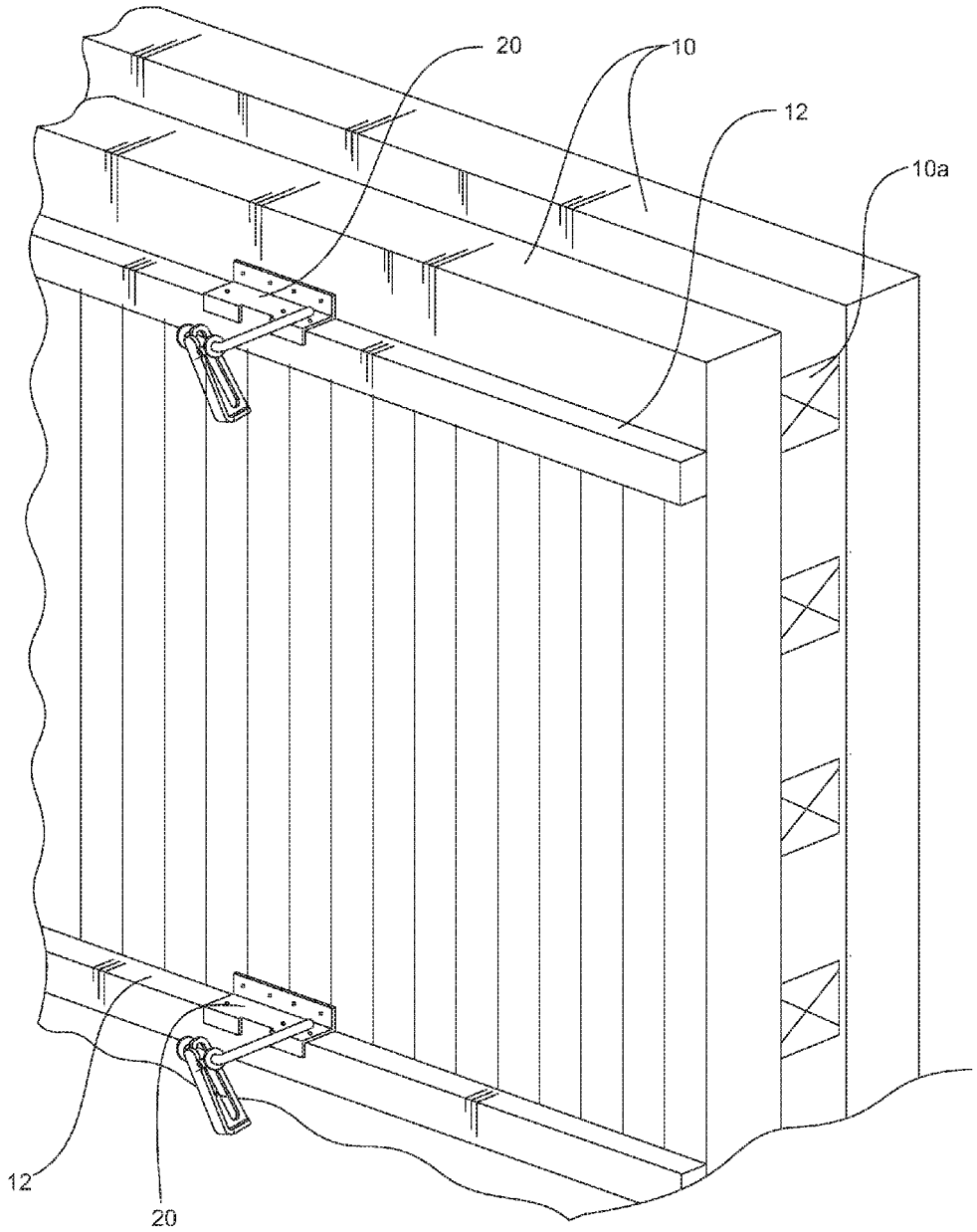
Fig. P6A

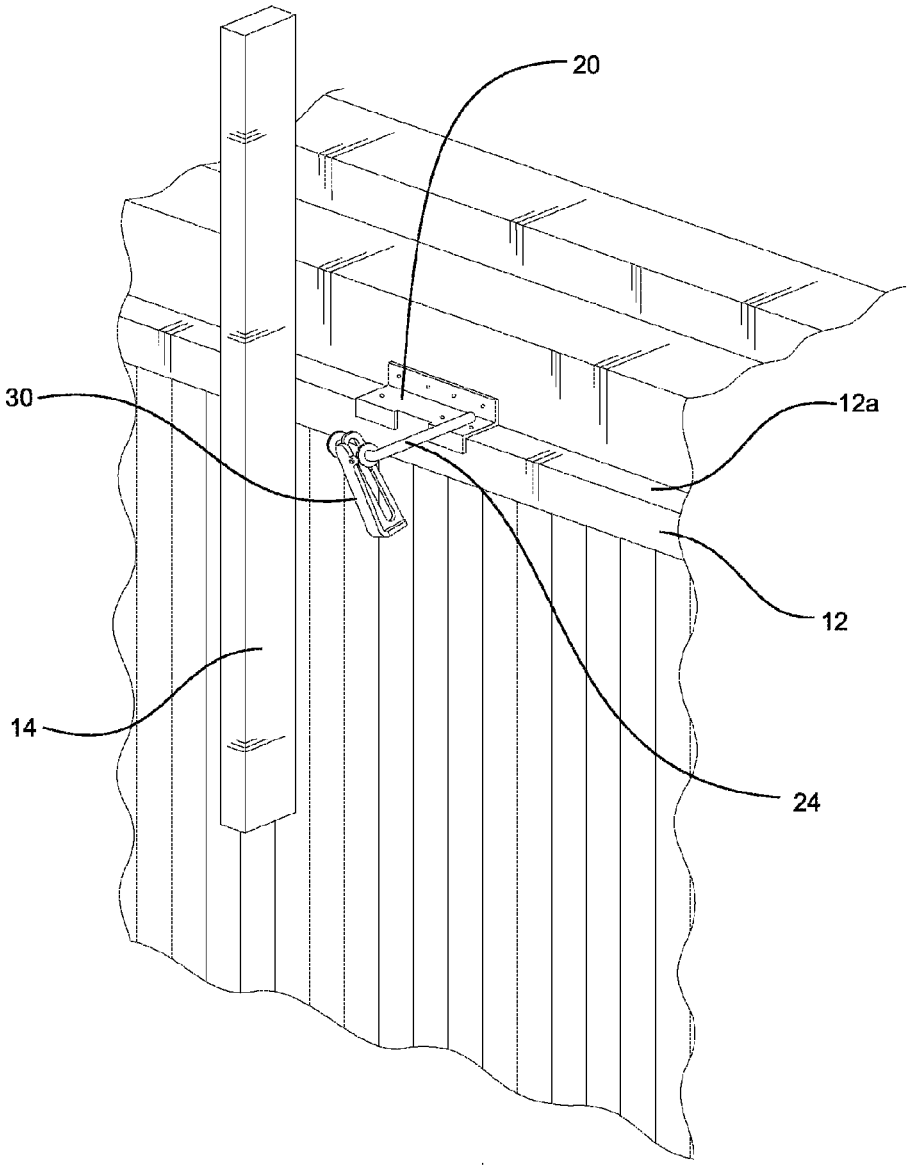
*Fig. P6B*

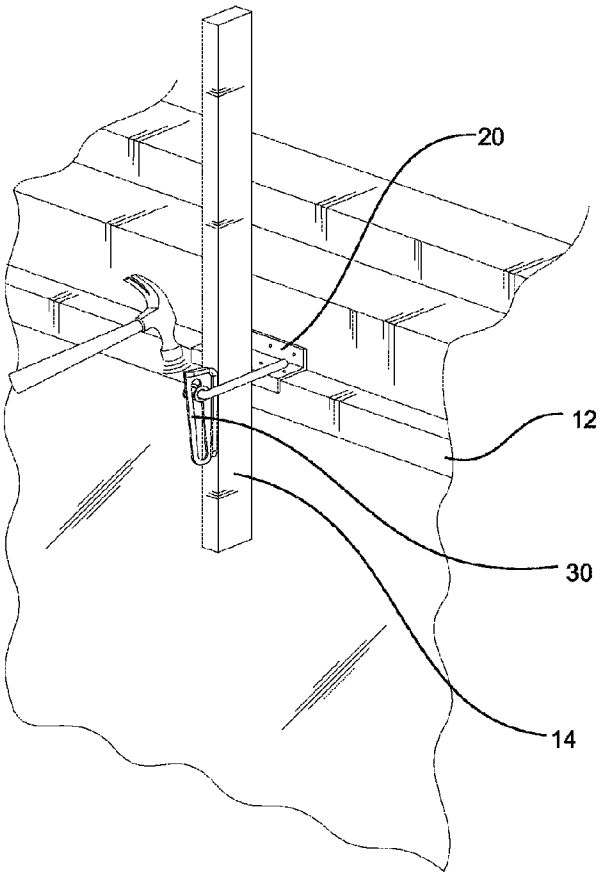
Fig. P6D
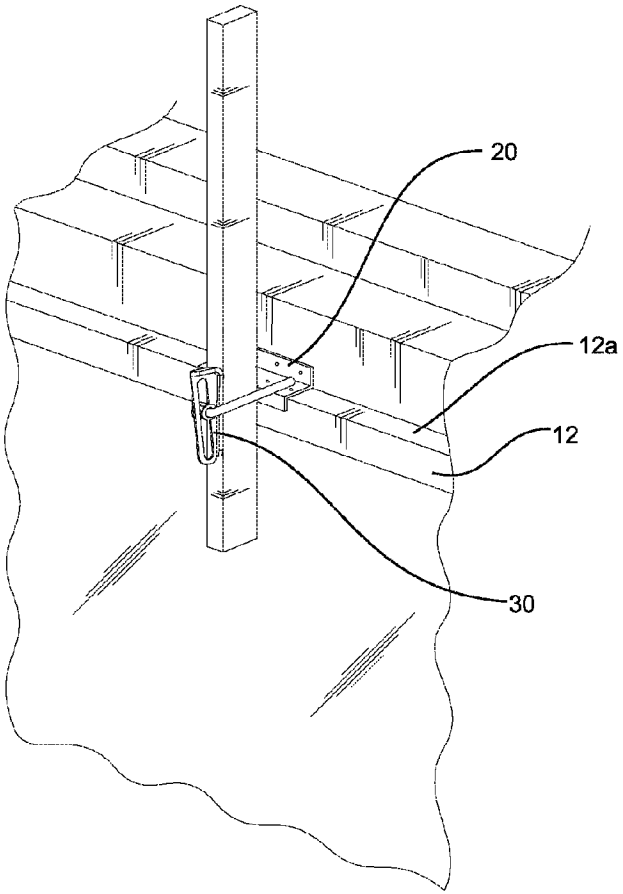
Fig. P6C

STRONGBACK WALER BRACKET AND METHODS OF USING THE SAME

CROSS REFERENCE TO RELATED APPLICATIONS

This application claims the benefits under 35 U.S.C 119(e) of U.S. Provisional Application Ser. No. 62/127,872, filed Mar. 4, 2015, which is incorporated herein by reference in its entirety.

FIELD

Embodiments described herein relate, in general, to brackets, and, in particular, to a bracket used in concrete forming systems to secure a vertical strongback to a horizontal waler.

BACKGROUND

Insulated concrete forms (ICF) are known as part of a wall building system, often for below-grade foundation wall, for providing both the forming for the concrete pours and insulation. Hollow, rigid, polystyrene blocks are offset, dry-stacked to form walls with a chase for receiving concrete. The blocks are manufactured of polystyrene walls, spaced apart and secured together using plastic ladder-like ties. The block walls require supports or bracing during the concrete pour to plumb the walls to vertical and minimize bowing of the walls under hydraulics during filling. The bracing can also be used to provide catwalk or walkways for installer access.

Conventional scaffolding such as that with tele-posts and cross bracing is expensive and must be adapted for ICF. Therefore, there has been various ICF-specific bracing systems developed. Among such systems are those as set forth in US 2014/0166849 A1 to Fearn and U.S. Pat. No. 6,550,188 to Bollinger et al.

Applicant has found that while such systems are improved over adaptation of conventional scaffolding, there are still costs and installation hurdles that limit their acceptance in the industry.

SUMMARY

In embodiments disclosed herein, as in the case of US 2014/0166849, horizontal or laterally extending walers are applied to the ICF wall and then vertical stiff or strongbacks are arranged vertically, outwardly from the walers, and spaced along the wall. Conventional lumber is used for both the walers and strongbacks, typically 2×4 lumber. A bracket is provided for positioning and securing the strongbacks to the walers.

In US 2014/0166849 the bracket is first secured to the ICF for supporting the walers and the strongbacks are supported therefrom. The bracket supports a cam at a distal end, jamming the strongback into the waler, both of which are supported against a proximal base plate of the bracket. The 2×4s are arranged with their long dimension extending outwardly from the wall, and combined with the cam protrude over 9 inches outwardly from the ICF wall.

In contradistinction, the system disclosed herein secures the horizontal and lateral walers to the ICF, a proximal base of the brackets are secured to and spaced along the walers, and then strongbacks are located to each bracket. A wedge at an outwardly spaced and distal end of each bracket is used to jam its respective strongback inwardly against the waler.

Further, the walers are secured flat to the wall with the longest dimension vertical along the wall.

The brackets and strongbacks can be used in combination with complementary scaffolding brackets for supporting robust and stable walkways of significant size.

Accordingly, in one broad aspect a bracket for securing a vertical strongback to a horizontal waler secured to an insulated concrete (ICF) wall form is provided. The bracket comprises a flange adapted to be mounted to an upper surface of the horizontal waler. The flange has a proximal edge which abuts the wall form. The bracket further comprises a standoff connected to the flange. The standoff extends perpendicular to and beyond the waler to a distal end. A strongback-receiving pocket is defined between the waler and the distal end for receiving the strongback in a perpendicular relationship with respect to the waler. The bracket further comprises a wedge operatively coupled to the distal end of the standoff. The wedge is moveable between a locked position and a released position. In the released position, an installation gap exists between the wedge and the waler, and in the locked position, the strongback is pinched between the wedge and the waler for securing the strongback to the waler.

Accordingly, in another broad aspect a method of securing a vertical strongback to one or more vertically spaced, horizontal walers secured against an insulated concrete wall form is provided. The method comprises mounting a bracket to each waler with a proximal edge of a flange of the bracket abutting the wall form and a standoff of the bracket extending perpendicular to and beyond the waler to a distal end for forming a strongback-receiving pocket between the waler and the distal end. The strongback is arranged in a perpendicular relationship with respect to the one or more walers by locating the strongback in the strongback-receiving pocket. Finally, the strongback is secured to each waler by moving a wedge operatively coupled to the standoff's distal end against the strongback for pinching the strongback between the waler and the wedge.

Accordingly, in another broad aspect a system for horizontally and vertically supporting an insulated concrete wall form for receiving concrete is provided. The system includes at least one waler secured horizontally on an outside surface of the wall form and at least one vertical strongback. The system further comprises at least one strongback bracket for securing the at least one strongback to the at least one waler. The at least one strongback bracket comprises a flange adapted to be mounted to an upper surface of the horizontal waler and a standoff connected to the flange and extending perpendicular to and beyond the waler to a distal end. A strongback-receiving pocket is defined between the waler and the distal end for receiving the strongback in a perpendicular relationship with respect to the waler. The strongback bracket further comprises a wedge operatively coupled to the distal end of the standoff which in a locked position pinches the strongback between the wedge and the waler for securing the strongback to the waler. The system further comprises at least one scaffold-supporting bracket supported by the strongback bracket. The scaffold-supporting bracket has a linearly extending arm having a U-shaped hook at a proximal end thereof. The hook extends about the strongback for supporting scaffold-supporting bracket on the strongback bracket.

Figure 7:
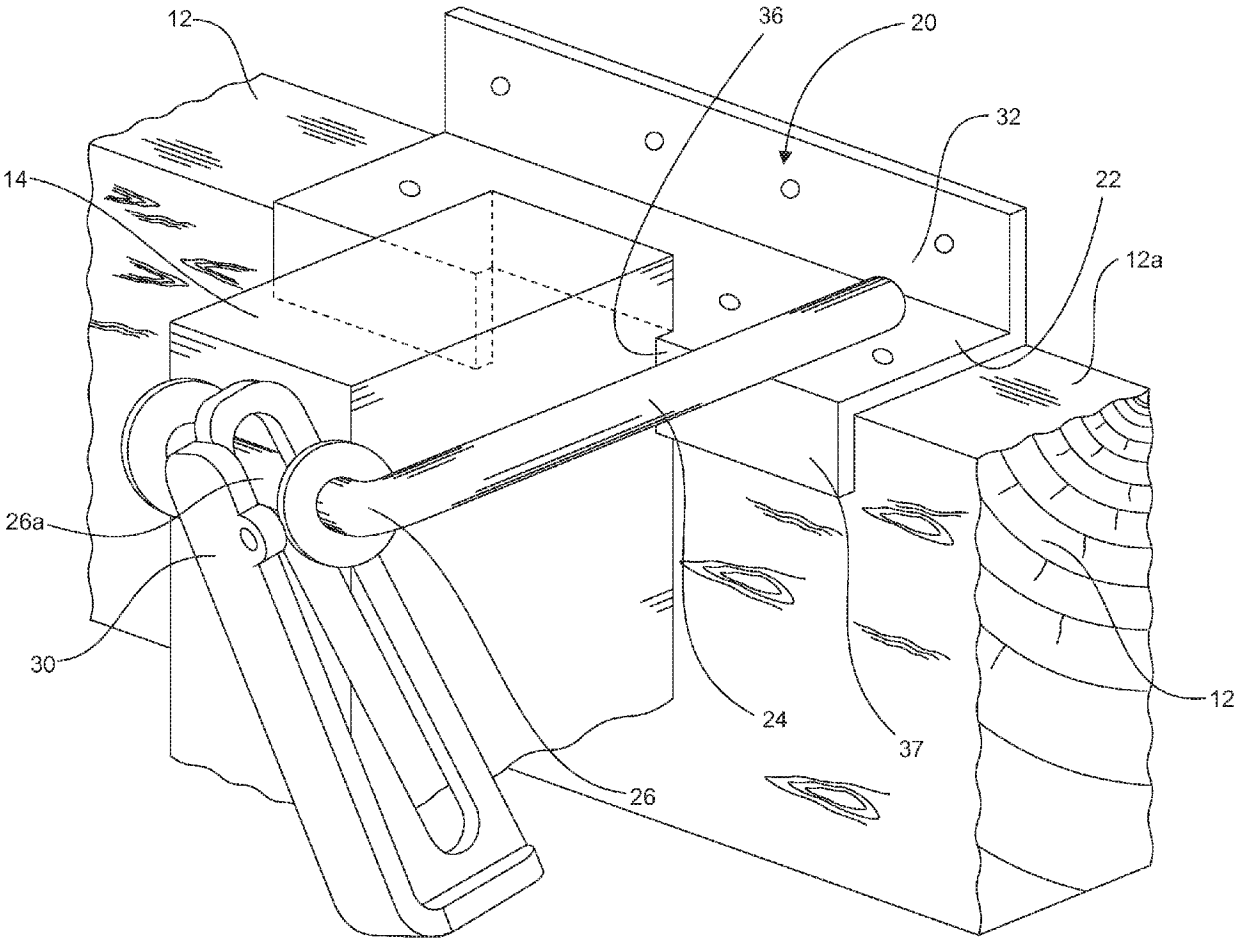
Figure 8A:
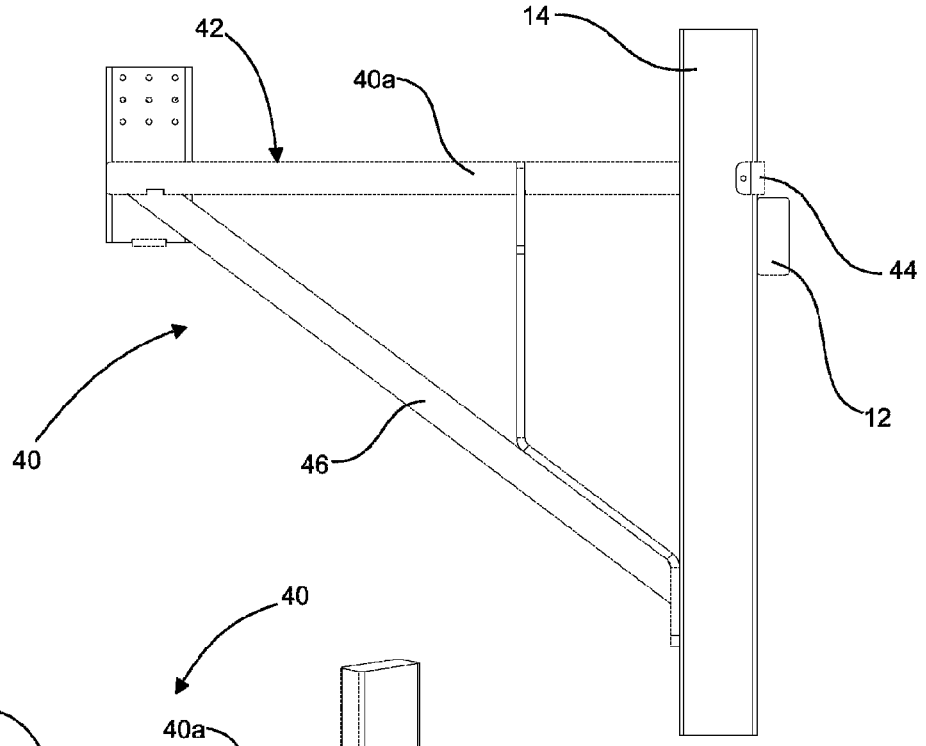
Figure 8B:
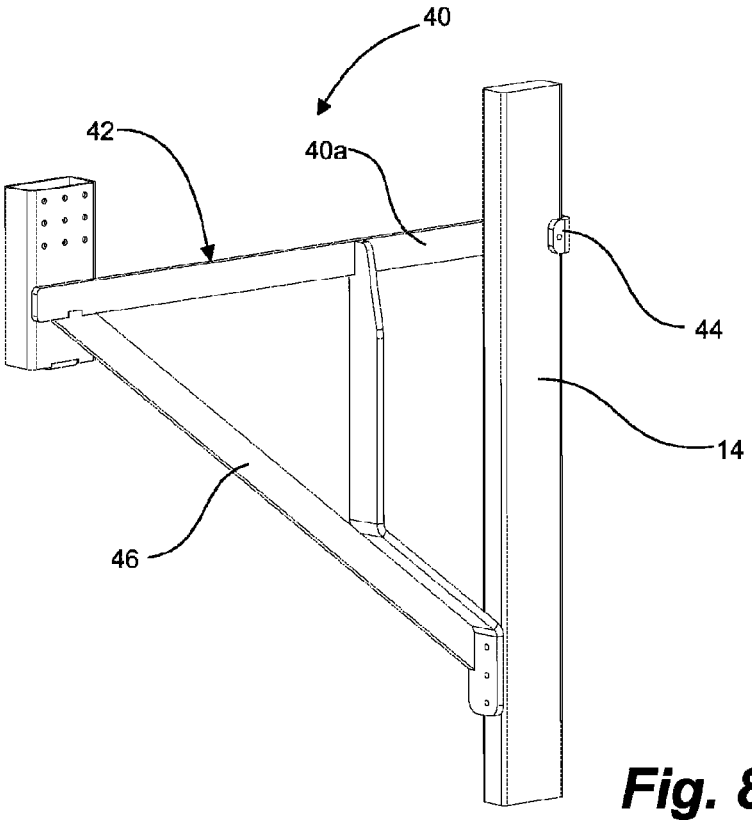
Figure 9A:
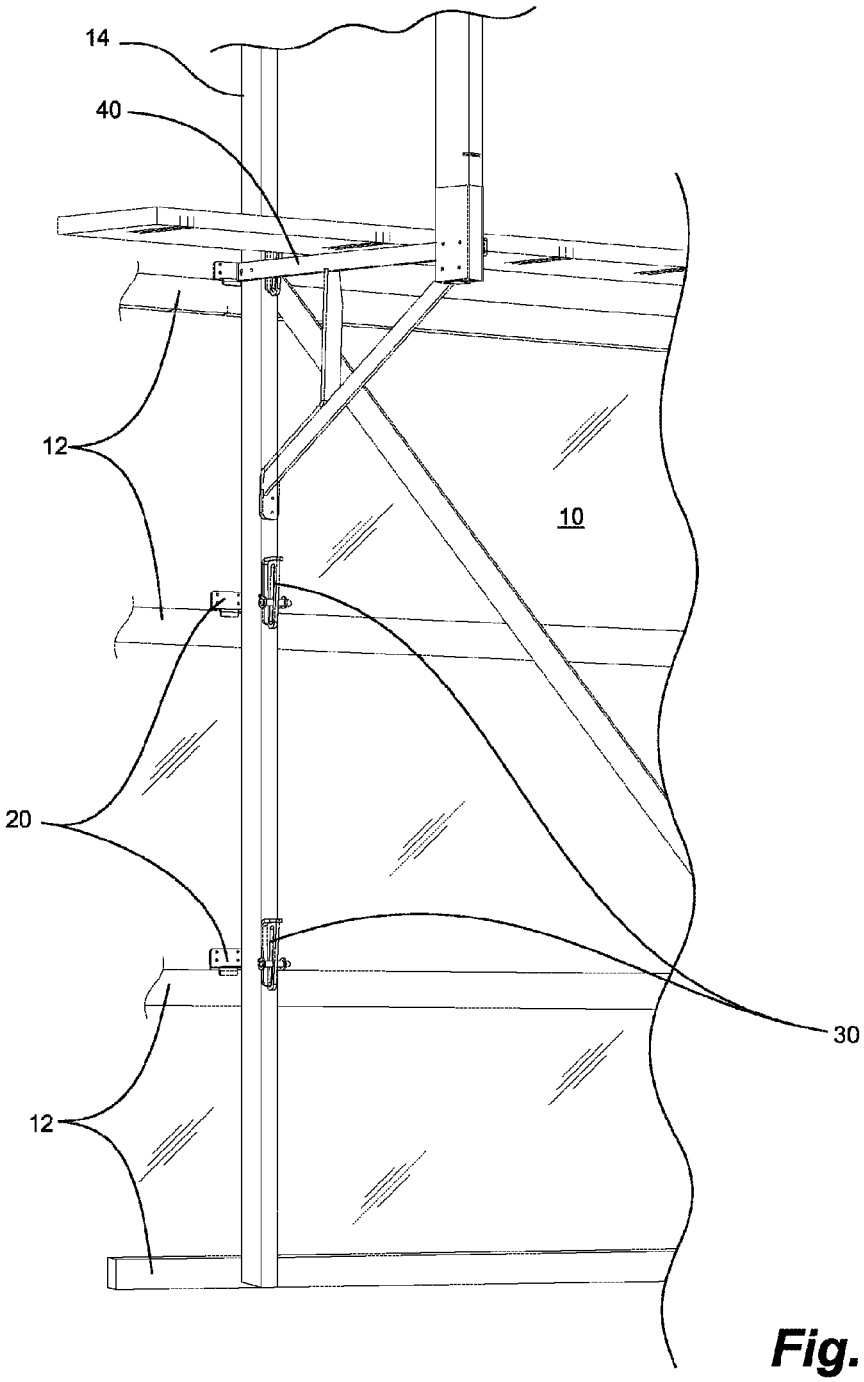
Figure 9B:
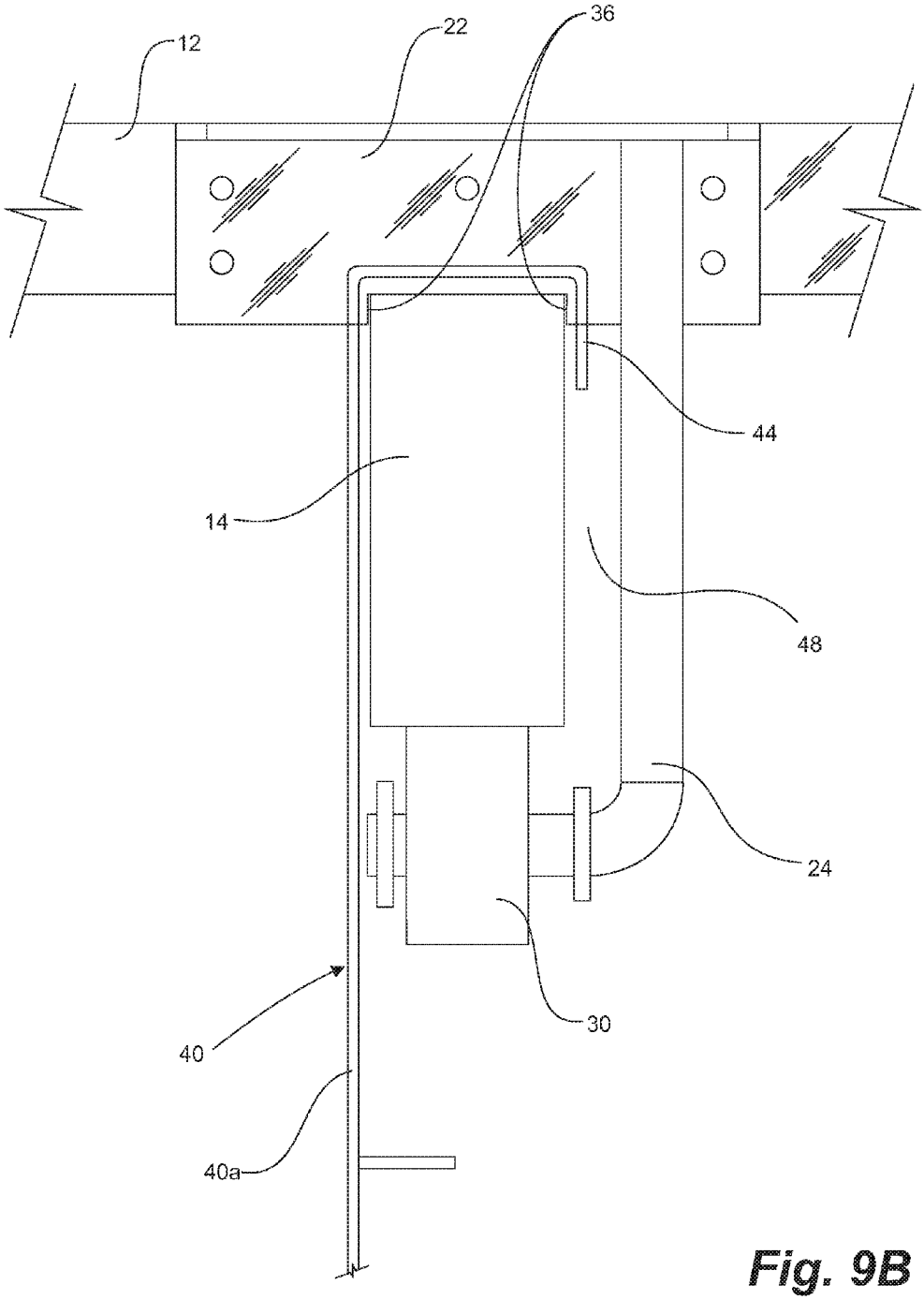
Figure 9C:
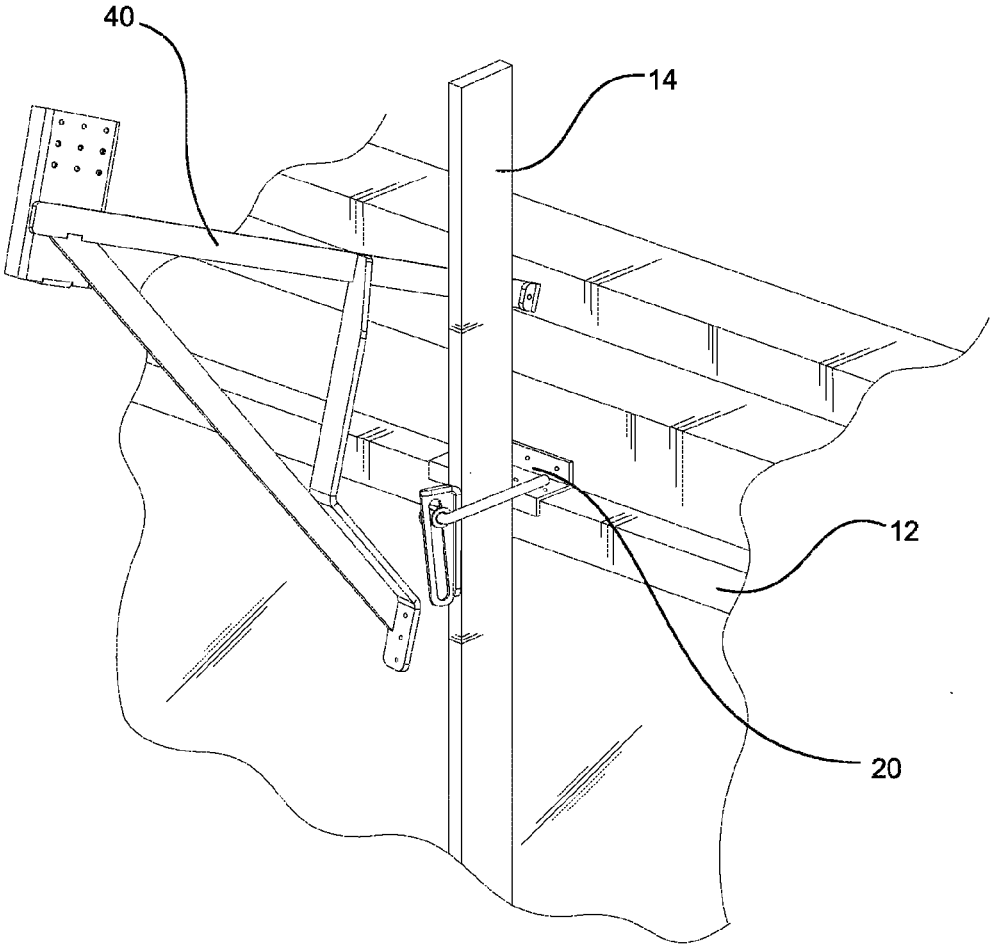
Figure 10B:
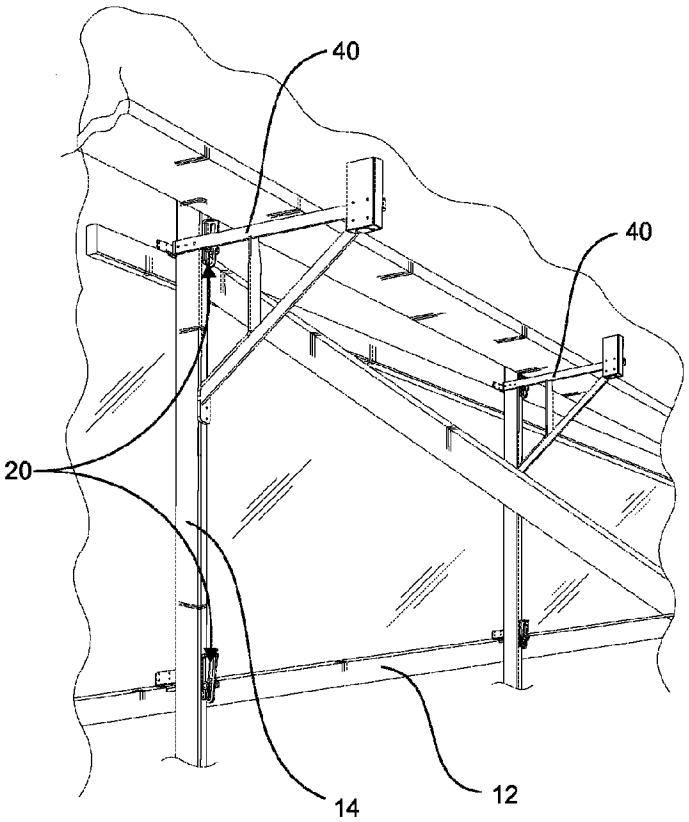
Figure 10A:
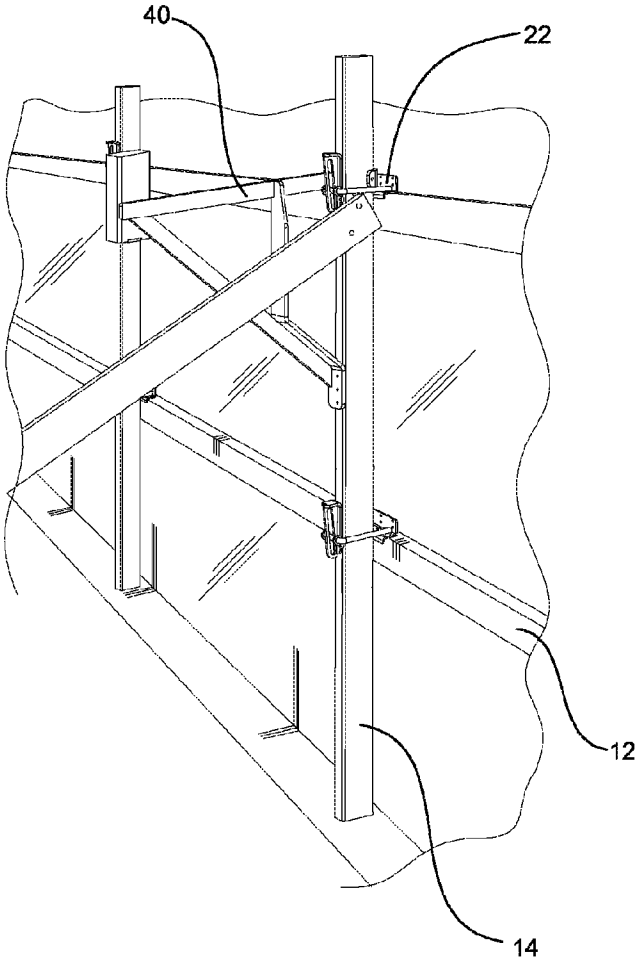

FIGS. P6A through P6D are perspective views illustrating step by step installation of brackets to spaced walers, installation of a strongback, and final securing of the wedge, namely FIG. P6A, illustrates two vertically-spaced walers on an ICF wall, having a bracket on each, inline vertically, the wedge hanging idle from the fulcrum of each bracket FIG. P6B illustrates a strong back fit to the two vertically-spaced and inline brackets, FIG. P6C illustrates the rotation of the wedge to its active or locked position and between the fulcrum and the strongback, FIG. P6D illustrates a striking with a hammer to drive the wedge firmly between the fulcrum and the strongback, the strongback being wedged firmly against the waler;

FIG. 7 is a rough perspective sketch of a bracket supported on a waler, and a strongback positioned therein, prior to wedge-securing therein, the wedge hanging loose or in a released position;

FIG. 8A is a side view of an embodiment of the scaffolding brace;

FIG. 8B is a perspective view of the scaffolding brace of FIG. 8A;

FIG. 9A is a perspective view of four vertically spaced walers, four corresponding brackets and triangular scaffolding braces at the third bracket for supporting planks for forming a walkway, the scaffolding braces distal ends supporting posts for forming a safety fence or barrier for personnel on the walkway;

FIG. 9B is a top view sketch of a bracket supported on a waler, a strongback wedge-secured therein and a scaffolding brace supported thereon, the bracket having a strongback-locating or side-to-side alignment notch for spacing the strongback laterally from the standoff for receiving between the strongback and the standoff a scaffolding bracket hook end;

FIG. 9C is a perspective illustration of a workman installing a scaffolding bracket about a strongback for support upon a bracket as illustrated in FIG. P6D; and FIGS. 10A and 10B are right side and left side views respectively of the scaffolding brace supported on a bracket, FIG. 10B further illustrating a walkway supported thereon.

DETAILED DESCRIPTION

Figure 1A:
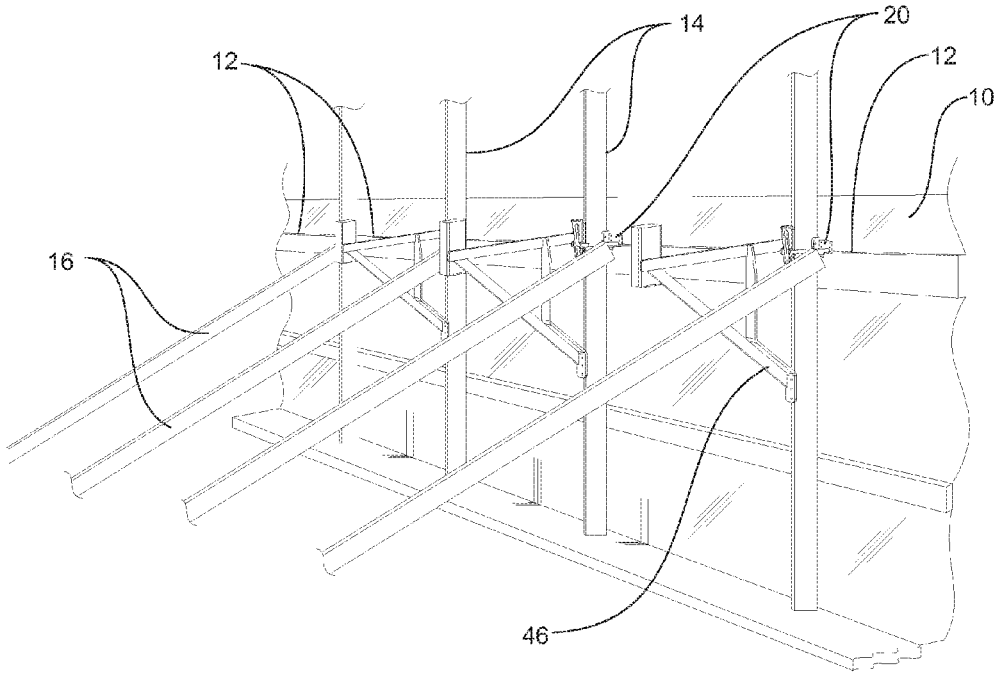
FIG. 1A is a perspective view of an ICF wall supported by a plurality of walers, strongbacks, and diagonal braces, the walers and strongbacks connected using an embodiment of a bracket described herein.
Figure 1B:
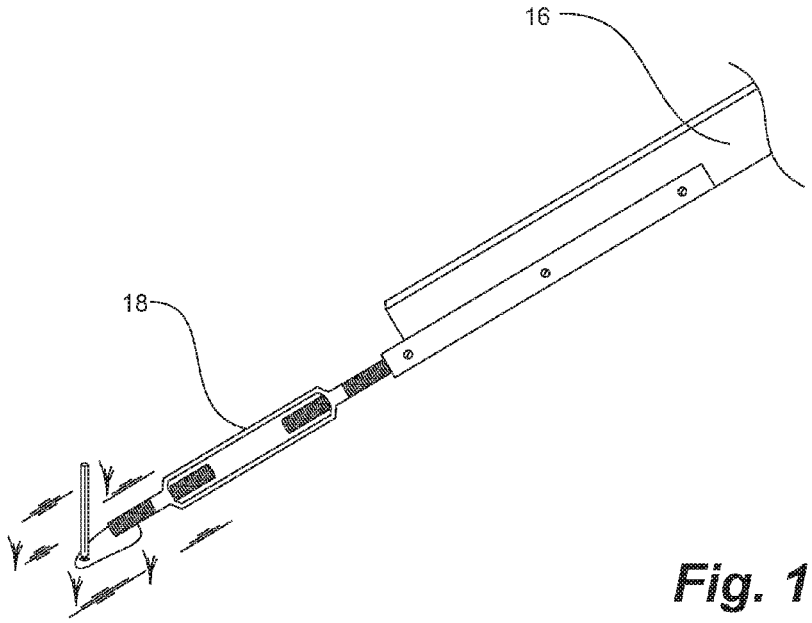
FIG. 1B is a view of a turnbuckle for adjusting the foot of the diagonal braces.
Figure 2:
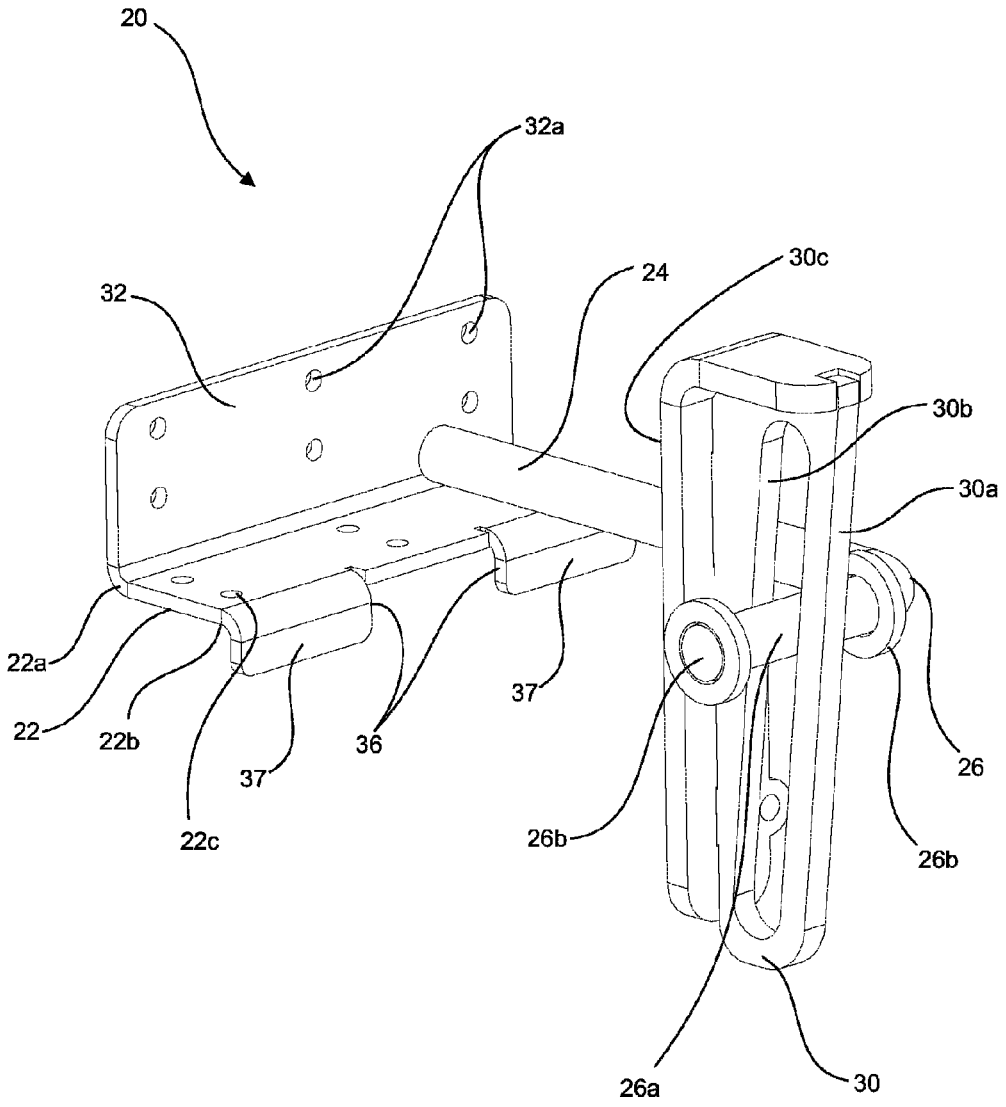
FIG. 2 is a perspective view of an embodiment of the present bracket.
Figure 3A:
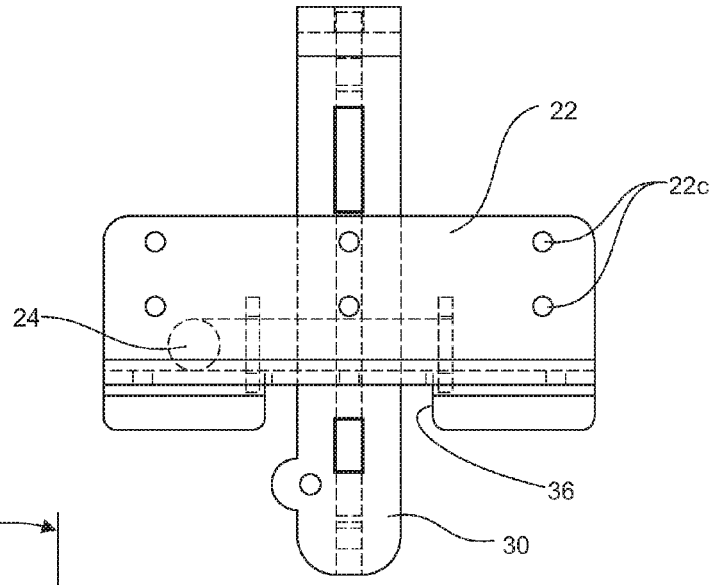
FIGS. 3A and 3B are back and right side views of the bracket of FIG. 2.
Figure 3B:
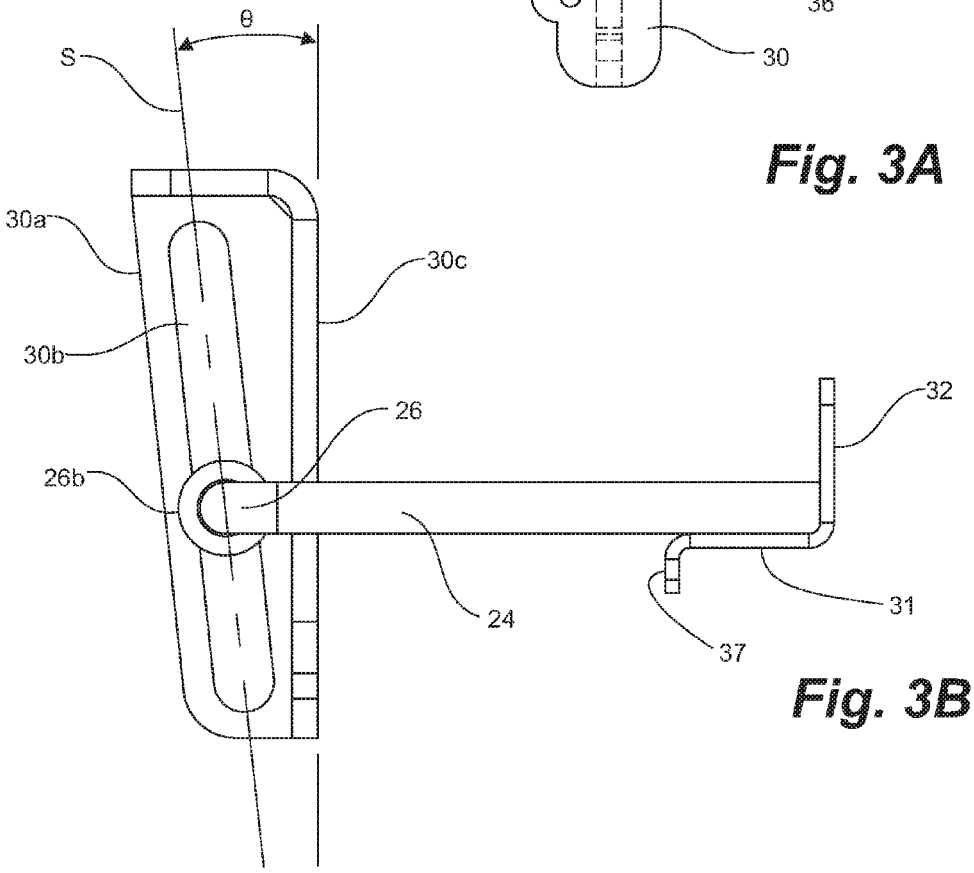
Figure 4B:
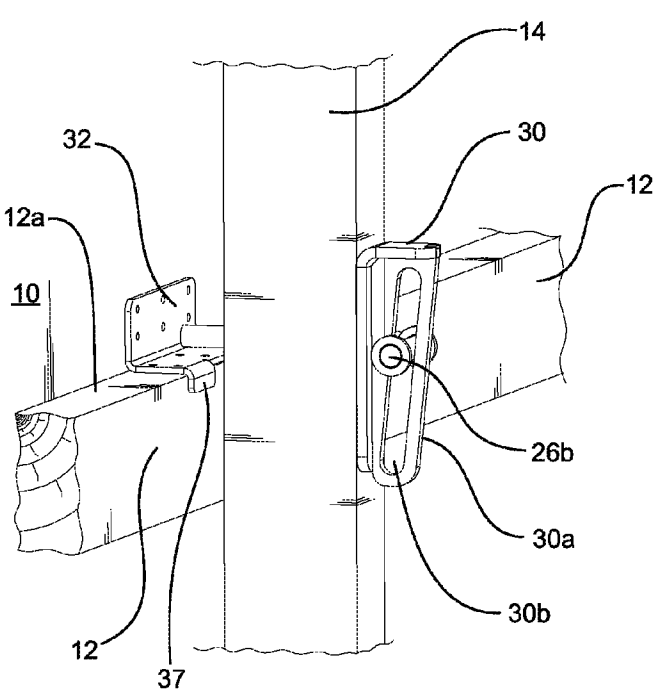
FIG. 4B is a left side perspective view of the bracket of FIG. 2 supported on a waler and having a strongback wedge-connected therein.
Figure 4A:
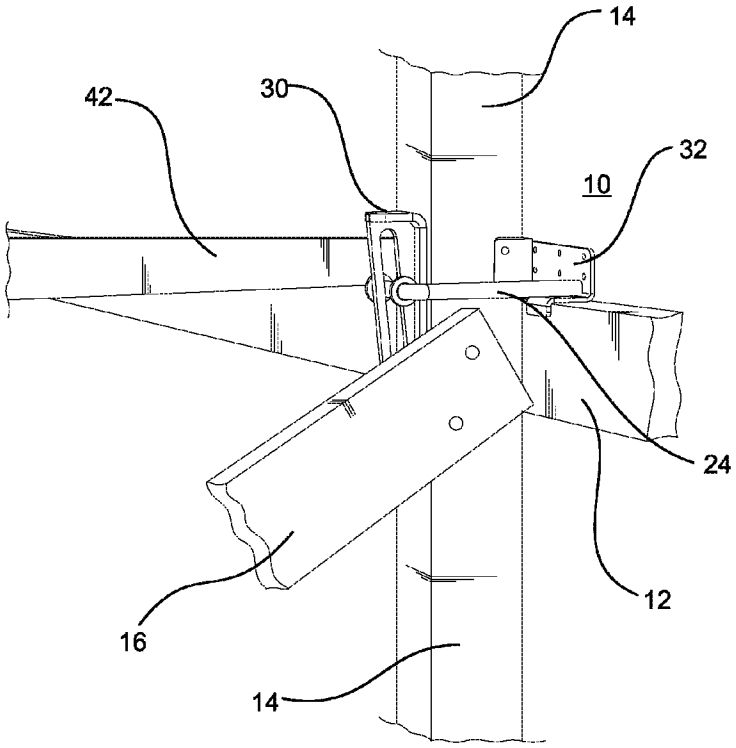
FIG. 4A is a right side perspective view of the bracket of FIG. 2 supported on a waler and having a strongback wedge-connected therein and a scaffolding brace is supported thereon.

In more detail, and with reference to FIG. 1A, an ICF wall 10 is temporarily supported by a frame of plurality of horizontally extending walers 12, vertical strongbacks 14, and diagonal braces 16. The walers 12 are secured to plastic ties 10*a* molded into the ICF wall 10. The angle of the vertical strongbacks 14 can be adjusted using turnbuckles 18 at the foot of each diagonal brace.

The vertical strongbacks 14 are connected to the horizontal walers 12 using one or more brackets 20 spaced horizontally along the walers 12.

In one embodiment and as shown in FIGS. 2-4B, each bracket 20 comprises a flange 22 which is adapted to be mounted to an upper surface 12*a* of the waler 12. The flange 22 has a proximal edge 22*a* which abuts the wall form 10. The bracket 20 further comprises a standoff 24 connected to the flange 22 and extending perpendicular to the waler 12 to a distal end 26. A strongback-receiving pocket 28 is defined between the waler 12 and the distal end 26 for receiving the strongback 14 in a perpendicular relationship with respect to the waler 12. The bracket 20 further comprises a wedge 30 operatively coupled to the distal end 26 of the standoff. In operation, the distal end 26 forms a fulcrum for movement of the wedge 30 between a locked position and a released position. The spatial arrangement of the proximal edges 22*a* of the flanges abutting the wall form 10, the length of the standoff to the distal end 26, the depth of the waler 12 (typically 1½" for a flat-mounted 2×4) and the wedge 30 all cooperate to accommodate the strongback 14. The strongback 14 is typically arranged edge-wise (typically 3½" for a 2×4) between the waler 12 and the wedge 30.

In the locked position, the strongback 14 is pinched between the wedge 30 and the waler 12 for securing the strongback 14 to the waler 12. In the released position, the strongback 14 is loosely and removably located in the strongback-receiving pocket 28 and an installation gap exists between the strongback 14 and the standoff's distal end 26.

The bracket 20 has at least a horizontal base plate 31 or flange 22 for resting upon the upper surface 12*a* of the waler 12. In one embodiment, the flange 22 can be formed of an angle structure or plate formed in a L-shape or Z-shape.

In one embodiment, in addition to securing to the waler 12, the bracket 20 may be further secured to the wall form 10. In this embodiment, the flange 22 further comprises a vertical portion or back plate 32 extending upwardly from the base plate 31 for abutting the wall form 10, preferably secured to the ties 10*a* for added strength. The vertical portion extends upwardly from the proximal edge 22*a* of the flange 22 and forms a "L" shape with the flange 22. In addition to being an attachment structure of the bracket, the back plate 32 also provides a large stop to rest against the ICF 10. The back plate 32 is secured to the ICF and therefore to the framing system using fasteners (not shown).

In one embodiment, the standoff 24 is integral with the flange 22, such as, such as by welding and extends parallel to the flange. With the flange 22 aligned on the upper surface 12*a* of the waler 12, the standoff 24 extends perpendicularly from the wall 10. The distal end 26 of the standoff 24 is spaced from the flange 22 sufficiently to form the strongback-receiving pocket 28 between the flange 22, the distal end 26 and laterally backed or delimited by the standoff. The strongback 14 is accepted in the pocket 28 with an installation gap between the waler 12 and the wedge 30 to provide for some additional fit tolerance.

In one embodiment, the wedge 30 has a ramp portion 30*a* of varying thickness and the distal end 26 of the standoff 24 is fit within a slot 30*b* formed in the ramp portion 30*a*. The slot 30*b* has an axis S at an angle θ to a base portion 30*c* of the wedge 30. The wedge 30 is moveable along the slot 30*b* to vary the thickness of the wedge 30 and to the locked position wherein the base portion 30*c* of the wedge 30 is jammed or forced against the strongback 14 for securing the strongback between the wedge 30 and the waler 12.

In one embodiment, the distal end 26 further comprises a short shaft 26*a* projecting perpendicularly away therefrom. The short shaft 26*a* extends through the slot 30*b* formed through the ramp portion 30*a* of the wedge 30. In order to prevent decoupling of the shaft 26*a* from the slot 30*b*, opposite ends of the shaft can be provided with spaced washers 26*b* for sandwiching the wedge 30 therebetween. The short shaft 26*a* rests along an outer face of the strongback 14 when the strongback is located in the pocket 28. The strongback 14 is sandwiched between the wedge 30 and the waler 12 by moving the wedge 30 to the locked position to close the installation gap and secure the strongback 14 to the waler 12. Note that the strongback 14 is secured to the waler 12 and the wedge 30 does not impose any pull out force on the bracket 20, nor the waler 12 from the ICF 10.

In operation, walers 12 are secured to the ICF 10 using conventional securing means. Typically two or three vertically spaced walers 12 are provided for each floor of an installation. ICF 10 are conventionally pre-marked with indicators to enable ease of location of the integrated block ties/webs 10*a* for secure attachment thereto. The walers 12 are secured to the ties 10*a*. Each bracket's flange 22 is aligned with the top, outermost edge of each waler 12 and can also be aligned with the ties 10*a*. The brackets 20 are arranged vertically by using the ICF webs as a guide at in least pairs of brackets on vertically spaced walers.

In one embodiment, the vertical strongback 14 is secured to one or more vertically spaced, horizontal walers 12 by mounting the brackets 20, aligned vertically to each of the one or more walers 12. In the mounted position, the flange 22 of each bracket rests on the upper surface 12*a* of the waler 12 and the standoff 24 of each bracket 20 extends perpendicularly from the flange 22. The strongback 14 is arranged in a perpendicular relationship with respect to the walers 12 by locating the strongback 12 in each bracket in the vertically aligned strongback-receiving pockets 28. Finally, the strongback 14 is secured to each of the walers 12 by moving the wedge 30 operatively coupled to the distal end 26 of each of the brackets 20 to the locked position. In the locked position, the strongback 14 is pinched between the walers 12 and their respective wedges 30. A hammer can be used to forcibly secure the wedge 30 into the locked position.

Figure 6A:
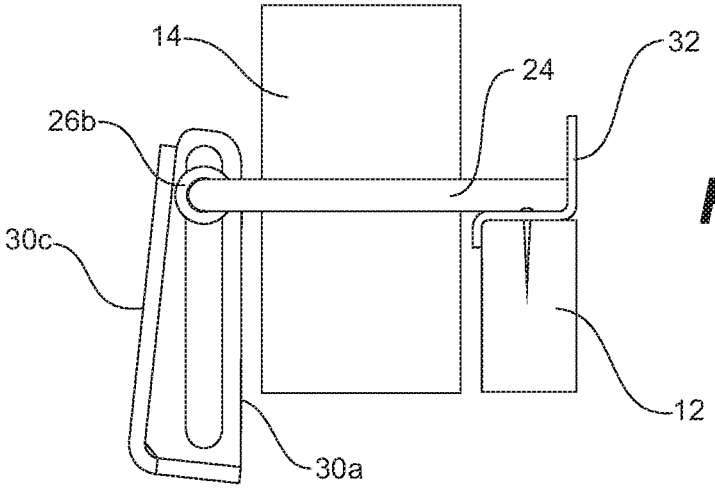
FIGS. 6A, 6B and 6C are side views of a waler and a bracket showing the respective steps of securing a bracket to the waler with the wedge hanging loose or inactive or in a released position, a strongback fit to the bracket with the wedge in a ready position, and lastly the wedge hammered tight to wedge-secure the strongback between the wedge and the waler.
Figure 6B:
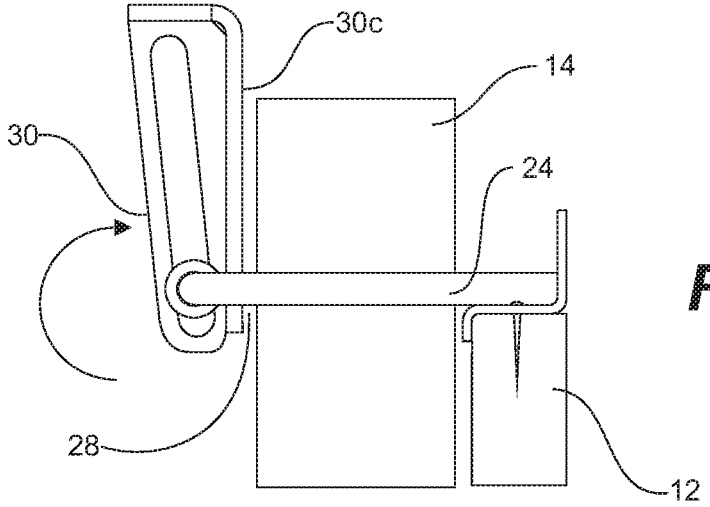
Figure 6C:
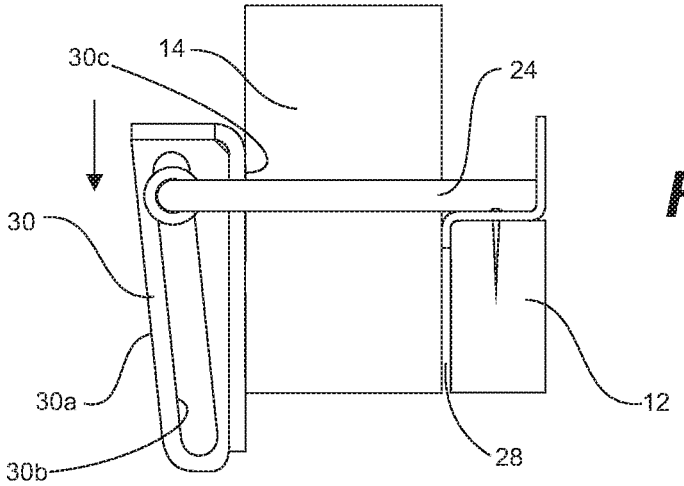

The process of illustration is shown at least in FIGS. 6A-6C and in additional FIGS. P6A-P6D. As shown in FIG. 6A, the bracket's flange 22 is secured to the upper surface 12*a* of the waler 12 and can also be secured to the ICF ties 10*a* using fasteners. Fasteners can extend vertically through mounting holes 22*c* provided in the flange 22 into the waler 12 and through mounting holes 32*a* provided in the flange's back plate 32 into the ICF ties 10*a*. As an example, a pair of vertically aligned brackets 20 are illustrated mounted to two vertically-spaced walers 12.

As shown in FIGS. 6B and 7, a strongback 14 is aligned within the pockets 28 of the spaced brackets 20, formed between the distal ends 26 of the standoffs 24 and the walers 12. The pockets 28 can serve as a convenient installation stop to rest the strongback 14 therein until securing with the respective wedges 30. As discussed below in more detail, each bracket 20 also includes a strongback locater or side-to-side alignment notch 36 to form an installation stop spaced laterally from the standoff 24, such for providing space for accessories including a scaffolding brace.

Once the strongback 14 is arranged in the pocket 28, the wedge 30 is rotated, from a gravity resting position, likely hanging freely upside down or released position, to an upright operative position or locked position. As shown in FIG. 6C, the strongback 14 is secured within the bracket 20 by hammering the wedge 30 down. The wedge ramp thickness increases as the wedge is hammered downwardly, pinching the strongback against the waler. The base portion 30*c* facing the strongback 14 is also fit with mounting holes for securing the wedge 30 in place with fasteners therethrough and into the strongback 14.

Figures 5A, 5B:
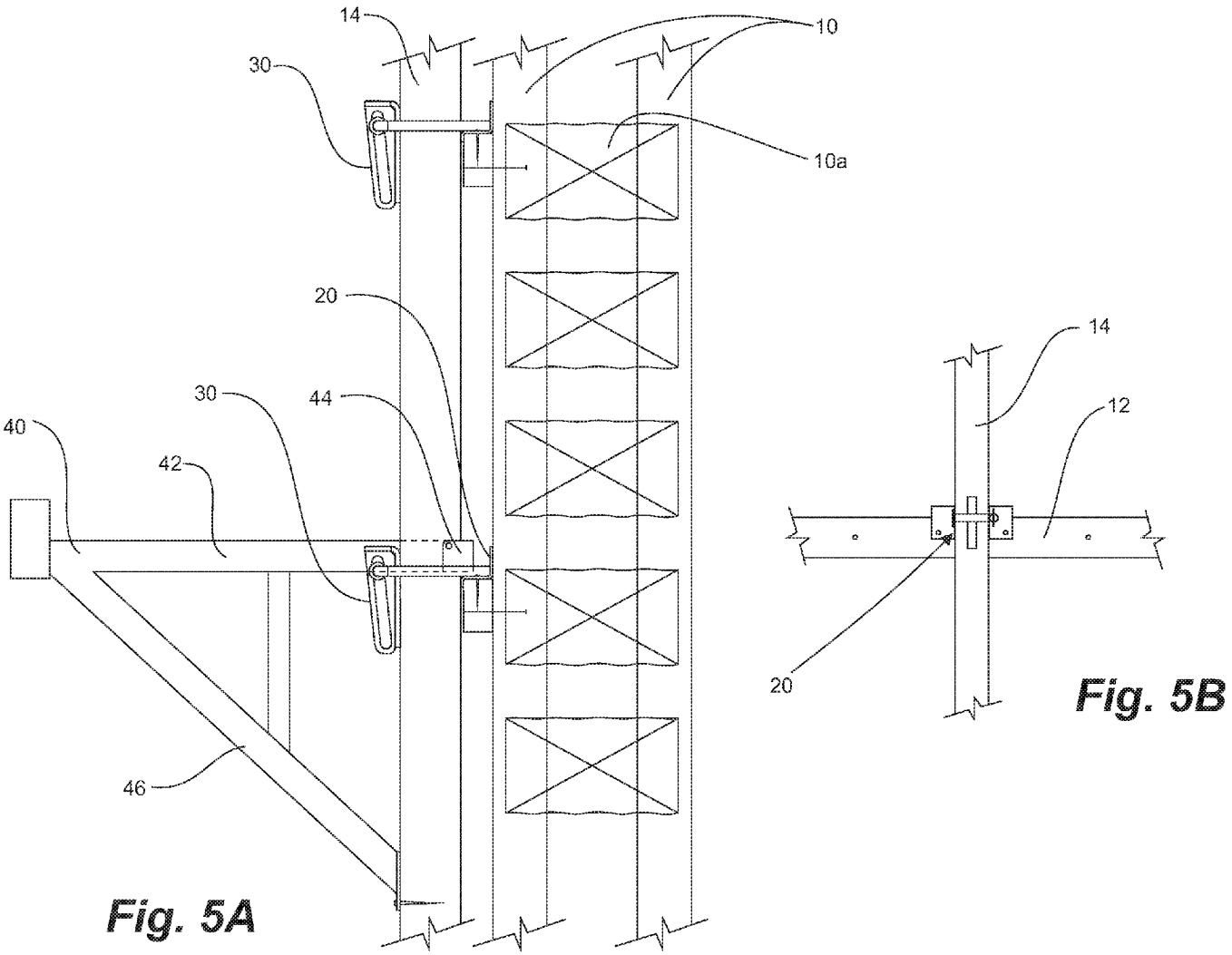
FIG. 5A is a side cross-sectional sketch of an ICF wall, ICF webs, two vertically spaced walers secured to the ICF webs and one strongback mounted to brackets supported on the walers, one scaffolding bracket being supported on a lower of the two brackets.
FIG. 5B is a front view of the bracket of FIG. 2, supported on a waler and having a strongback wedge-secured in the bracket.

Again, simply, and as shown in FIGS. 5A and 10A, a pair of brackets 20 are aligned vertically and secured to vertically spaced and horizontally-extending walers 12 and the webs of the ICF 10, a strongback 14 is fit within the respective upper and lower pockets and the wedges are hammered into place.

An example of the relevant specifications of the bracket 20 are as follows: the height of the back plate 32 is 1.635 inches, the thickness of the back plate is 0.135 inches, the distance between the back plate 32 and an inner surface of the lip 37 is 1.5 inches, the depth of the pocket 28 is about 3.5 inches, the length of the notch 36 is 1.730 inches, the diameter of the standoff is 0.920 inches, the diameter of the mounting holes in the flange 22 is 0.190 inches, the distance between two vertically aligned mounting holes in the flange 22 is 0.625 inches.

Further, with reference to FIG. 5A and FIGS. 8A-10B a scaffold-supporting bracket or brace 40 can be incorporated with the ICF bracket system. The brace 40 has a linearly extending arm 40*a* having a U-shaped hook 44 at a proximal end thereof that hooks about an inner face of the strongback 14. The arm 40*a* provides an outwardly extending platform base 42. Weight on the platform base 42 transfers force to a downwardly and inwardly extending angled support 46 that engages an outer face of the strongback 14. The scaffolding brace could be fit anywhere along the vertical extent of the strongback at the wedge locations, the hook and angled support being somewhat self-locking, however, conveniently, an installer would hang the hook end 44 just above a strongback bracket 20 for ease and security of vertical placement. While the hook end could rest on the standoff, additional stability is provided if the hook end were to rest directly on the flange's plate.

Accordingly, in an embodiment, the strongback 14 is arranged for support and securement slightly offset from the standoff with by side-to-side alignment notch 36. In one embodiment, the notch 36 is formed between a pair of lips 37 extending from the distal edge 22*b* of the flange 22 for maintaining side-to-side alignment of the strongback when the same is located within the receiving pocket 28. In one embodiment, the lips 37, 37 extend downwardly from the distal edge of the flange. The lips 37, 37 are downcomers from the flange 22. The lips align the flange 22 with the horizontally extending top and outermost edge of the waler 12. In other words, the upper surface 12*a* of the waler 12.

The installer can fit the strongback inner face to the notch 36 before securing with the wedge 30. A scaffolding hook space 48 remains between the standoff and the strongback for accepting the scaffolding hook end 44 and permitting same to rest upon the plate. The space 48 must at least be equal to the thickness of the hook end 44. The angled support 46 is then secured to the strongback 14, for safety, with a fastener therethrough.

The scaffolding brace 40 can have a post receptacle at an outer end for ease of installation of the posts of a safety barrier and toe kick.

The configuration and use of the walers 12, wedges 30 and strongbacks 14 being attached to the ICF webs makes for easier wall straightening by moving a larger percent of the wall at one time instead of pushing on one point.

In an example installation,

STEP ONE: Lay out on the footing the vertical brace spacing prior to installing ICF. Bracket spacing is recommended at 8 feet on center.

STEP TWO: At every laid out brace location, tie down the ICF blocks to one another vertically using plastic ties.

STEP THREE: Once the ICF wall 10 is up about three courses high, shimmed and leveled, then: Attach a first horizontal 2×4 waler 12 on the flat. The first waler (H1) is attached 0 to 1.5 ICF courses off the footing, a second waler (H2) is attached 2.5 courses from the top of wall or at the installer's preferred working height, and a third waler (H3) is attached 1.5 to 6 inches below the top of the last ICF block. Attach the horizontal 2×4 walers to the ICF webs/ties with 3" deck screws or ICF screws every 4 feet on center. Also a screw can be provided at every vertical brace location and the ends of the horizontal 2×4s. For best results, the ends of the horizontal 2×4s are staggered from row to row by a minimum of 4 feet.

STEP FOUR: Once two rows of horizontal 2×4 walers are installed, start attaching the brackets 20 to the upper surfaces 12*a* of the walers 12.

STEP FIVE: Once the brackets 20 are attached to at least two horizontal rows of 2×4 walers it is time to install the vertical 2×4 strongbacks 14. The 2×4 vertical strongback slides laterally into the receiving pockets 28 provided in the bracket 20. The wedge 30 is moved into the locked position and the base portion 30*c* of the wedge 30 is hammered vertically to wedge against the vertical 2×4 to pinch the strongback 14 tightly in place against the waler.

STEP SIX: Attach a form aligner or turnbuckle to a 2×4 to create a diagonal brace. Attach the newly created diagonal 2×4 brace by screwing it to the side of the vertical strongback with 3 inch deck screws. Using a 4 foot level get the wall close to level then pin the form aligner to the ground. Turn the turnbuckle to achieve the fine tuning for wall levelling.

STEP SEVEN: Continue building the ICF wall and attach the horizontal 2×4 walers as you build the ICF wall up. Preferably the ends of the walers are staggered 4 feet from the horizontal waler of the row below. The brackets are attached as the horizontal walers are attached.

STEP EIGHT: scaffold braces are hooked around the back of the vertical strongback at the bracket row which is 2.5 courses down from the top. The scaffold brace hooks behind the vertical strongback and rests on top of the bracket. The scaffold brace is fastened to the strongback through strongback screw holes provided in the side and bottom of the brace and screwed to the vertical strongbacks.

STEP NINE: Walk platforms are set in place as per local Health and Safety requirements. The scaffolding brace is wide enough to accommodate commercial scaffolding walk platforms. The strongback verticals are laterally spaced sufficiently to accommodate the work platforms.

STEP TEN: One can drop safety rail posts in the handrail pockets and attach handrails as required.

STEP ELEVEN: One can set string lines and miscellaneous braces as required for the ICF installation and commence concrete pour.

Note that many tall ICF pours tend to bow in the bottom two thirds of the ICF wall because conventional vertical braces cannot take the weight and the diagonal braces are connected near the top of the wall. A result can be that the top couple rows are straight but the wall is not plumb due to the bottom two thirds of the wall bowing. The bracket and system of the current embodiments is readily adaptable and easy to add extra diagonals in tall wall applications. Two diagonals help take the bow out of tall pours keeping the walls plumb and much straighter. One can also add an extra string line at the intermediate diagonal height so the wall can be straightened once the concrete has reached that height during the pour. The scaffold brace can be set anywhere on the wall as long as the vertical strongbacks are in place. This is very helpful in tall wall situations setting the work platform at any height if needed.

I claim:

1. A bracket for securing a vertical strongback to a horizontal waler secured to an insulated concrete form (ICF) for a wall, the bracket comprising:

a flange adapted to be mounted to an upper surface of the horizontal waler and having a proximal edge for abutting the wall form;

a standoff connected to the flange and adapted to extend perpendicular to and beyond the waler to a distal end, a strongback-receiving pocket being defined between the flange and the distal end of the standoff for receiving the strongback in a perpendicular relationship with respect to the waler; and a wedge operatively coupled to the distal end of the standoff and moveable between a locked position and a released position, wherein in the released position, an installation gap exists between the wedge and the waler, and in the locked position, the strongback is pinched between the wedge and the waler for securing the strongback to the waler.

2. The bracket of claim 1, wherein the flange further comprises a vertical portion extending upwardly from the proximal edge for abutting the wall form.

3. The bracket of claim 2, wherein the flange and the vertical portion are provided with mounting holes for securing the flange and the vertical portion to the waler and ICF ties, respectively.

4. The bracket of claim 1, wherein the wedge has a ramp portion of varying thickness, the distal end of the standoff extending through a slot formed in the wedge, the slot forming the ramp portion and the wedge moveable therealong to the locked position to force a base portion of the wedge against the strongback.

5. The bracket of claim 4, wherein the base portion further comprises at least one mounting hole for securing the wedge to the strongback in the locked position.

6. The bracket of claim 1 further comprising a side-to-side alignment notch formed between a pair of lips extending from a distal edge of the flange and adapted for maintaining side-to-side alignment of the strongback located within the receiving pocket.

7. The bracket of claim 6, wherein the lips are adapted to extend downwardly over the waler.

8. The bracket of claim 1, wherein the standoffs distal end further comprises a short shaft projecting perpendicularly away therefrom.

9. The bracket of claim 8, wherein the wedge has a ramp portion of varying thickness, the distal end of the standoff extending through a slot formed in the wedge, the slot forming the ramp portion and the wedge moveable therealong to the locked position to force a base portion of the wedge against the strongback, and wherein the short shaft extends through the slot formed in the ramp portion.

10. The bracket of claim 9, wherein opposite ends of the short shaft are provided with washers for sandwiching the wedge therebetween and preventing decoupling of the wedge from the short shaft.

11. A method of securing a vertical strongback to one or more vertically spaced, horizontal walers secured against an insulated concrete wall form; the method comprising:

mounting a bracket to each waler with a proximal edge of a flange of the bracket abutting the wall form and a standoff of the bracket extending perpendicular to and beyond the waler to a distal end for forming a strongback-receiving pocket between the waler and the distal end;

arranging the strongback in a perpendicular relationship with respect to the one or more walers by locating the strongback in the strongback-receiving pocket; and securing the strongback to each waler by moving a wedge operatively coupled to the standoffs distal end against the strongback for pinching the strongback between the waler and the wedge.

12. The method of claim 11 further comprising securing the bracket to the wall form at ties molded to an inner face of the wall form.

13. The method of claim 11, wherein prior to moving the wedge against the strongback, the wedge is in a released position to form an installation gap between the standoffs distal end and the waler.

14. The method of claim 11 further comprising locating the strongback in a side-to-side alignment notch formed on the flange.

15. The method of claim 11 further comprising spacing the strongback laterally from the standoff by locating the strongback in a side-to-side alignment notch formed between a pair of lips extending from a distal edge of the flange.

16. The method of claim 15 further comprising positioning a scaffold-supporting bracket within the bracket by arranging a linearly extending arm of the scaffold-supporting bracket perpendicular to the strongback and placing a U-shaped hook of the scaffold-supporting bracket about the strongback.

17. A system for horizontally and vertically supporting an insulated concrete wall form for receiving concrete, the system including at least one waler secured horizontally on an outside surface of the wall form and at least one vertical strongback, the system comprising:

at least one strongback bracket for securing the at least one strongback to the at least one waler, wherein the at least one strongback bracket comprises:

a flange adapted to be mounted to an upper surface of the horizontal waler, a standoff connected to the flange and extending perpendicular to and beyond the waler to a distal end, a strongback-receiving pocket being defined between the waler and the distal end for receiving the strongback in a perpendicular relationship with respect to the waler and a wedge operatively coupled to the distal end of the standoff which in a locked position pinches the strongback between the wedge and the waler for securing the strongback to the waler; and at least one scaffold-supporting bracket, supported by the strongback bracket, having a linearly extending arm having a U-shaped hook at a proximal end thereof and wherein the hook extends about the strongback for supporting scaffold-supporting bracket on the strongback bracket.

18. The system of claim 17, wherein the at least one strongback bracket further comprises a side-side alignment notch formed on the flange for laterally spacing the at least one strongback from the standoff to accept the hook.

* * * * *